US007435146B2

(12) United States Patent
Oguma

(10) Patent No.: US 7,435,146 B2
(45) Date of Patent: Oct. 14, 2008

(54) FORWARD AND REVERSE DRIVE SWITCHING DEVICE FOR OUTBOARD MOTOR

(75) Inventor: Takahiro Oguma, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 31 days.

(21) Appl. No.: 11/593,252

(22) Filed: Nov. 6, 2006

(65) Prior Publication Data

US 2007/0105462 A1 May 10, 2007

(30) Foreign Application Priority Data

Nov. 4, 2005 (JP) ..... 2005-321288

(51) Int. Cl.
*B63H 20/14* (2006.01)
*B63H 21/21* (2006.01)

(52) U.S. Cl. ..... 440/75; 440/86

(58) Field of Classification Search ..... 114/75
See application file for complete search history.

(56) References Cited

U.S. PATENT DOCUMENTS 6,692,320 B1 * 2/2004 Sawyer ..... 440/86
6,905,382 B2 * 6/2005 Ochiai et al. ..... 440/86

FOREIGN PATENT DOCUMENTS

JP 2004-244003 9/2004
JP 2004-245350 9/2004

* cited by examiner

*Primary Examiner*—Jesú D Sotelo
(74) *Attorney, Agent, or Firm*—Knobbe, Martens, Olson & Bear, LLP

(57) ABSTRACT

A forward and reverse drive switching device for an outboard motor can include a switching mechanism that is actuated so as to set a propeller to a forward drive mode or a reverse drive mode. An actuator can have an electric motor and can serve as a drive source for the switching mechanism. A coupling member can transmit a driving force from the actuator to the switching mechanism to actuate the switching mechanism. The coupling member can include a rod disposed on an axis of the electric motor and can have an end coupled to the switching mechanism with its other end coupled to the electric motor to permit retracting and extending movements of the rod along the axis through the operation of the electric motor.

7 Claims, 5 Drawing Sheets

FORWARD AND REVERSE DRIVE SWITCHING DEVICE FOR OUTBOARD MOTOR

PRIORITY INFORMATION

This application is based on and claims priority under 35 U.S.C. §119 to Japanese Patent Application No. 2005-321288, filed on Nov. 4, 2005, the entire contents of which is hereby expressly incorporated by reference herein.

BACKGROUND OF THE INVENTIONS

1. Field of the Inventions

The present inventions relate to a transmission control for a marine propulsion system, and more particularly, devices for switching the transmission of an outboard motor between forward and reverse drive modes including device having electric actuators.

2. Description of the Related Art

One type of forward and reverse transmission switching device for an outboard motor is disclosed in Japanese Patent Documents JP-A-2004-245350, JP-A-2004-244003. The forward and reverse drive switching devices for an outboard motor disclosed in these documents, specifically in FIGS. 27 through 29 thereof, include a switching mechanism that is actuated so as to set a propeller to a forward drive mode or a reverse drive mode. An actuator having an electric motor serves as a drive source for the switching mechanism. A coupling member transmits a driving force from the actuator to the switching mechanism to actuate the switching mechanism. The coupling member includes a reduction gear set adapted to transmit the force from the electric motor of the actuator to a shift lever of the switching mechanism with the speed reduced to cause the shift lever to pivot in a manner actuating the switching mechanism.

SUMMARY OF THE INVENTIONS

An aspect of at least one of the embodiments disclosed herein includes the realization that different coupling mechanisms can provide additional advantages in the context of switching or other mechanisms. For example, the gear set described above with reference to the Japanese Patent Documents JP-A-2004-245350, JP-A-2004-244003 has a relatively large configuration. The forward and reverse drive switching devices containing such gear set, therefore, tend to be large. Thus, the forward and reverse drive switching devices of this type present some difficulties in the context of outboard motors in terms of, for example, mountability (assembling characteristics). In addition, mechanical loss during power transmission by the gear set is relatively large.

Additionally, in the reduction gear set described above, a large torque is required for power transmission from the output side, or switching mechanism, to the input side, or electric motor; when the gear set is a worm gear, such power transmission is impossible.

In the event of a failure of the actuator for example, an operator may directly operate the shift lever of the switching mechanism, not through the operation of the actuator, but manually so as to manually actuate the switching mechanism. In this case, the operation force is applied to the switching mechanism, while being applied from the output side of the gear set to the input side. The actuation of the switching mechanism is thus hindered due to the large torque described above.

Thus, for the manual actuation of the switching mechanism as described above, the coupling between the shift lever of the switching mechanism and the gear set must be first released so that the operation force cannot be transmitted from the output side of the gear set to the input side, and then the shift lever is operated to actuate the switching mechanism. As a result, smooth manual actuation of the switching mechanism is effected.

In the conventional art, however, as described above, the coupling between the shift lever and the gear set must be first released for the manual actuation of the switching mechanism. Thus, the operation for the manual actuation of the switching mechanism can be cumbersome; namely, manual switching operation to the forward and reverse drive switching device can be cumbersome.

Thus, in accordance with an embodiment, a forward and reverse drive switching device for an outboard motor can comprise a switching mechanism configured to selectively set a propeller of the outboard motor to a forward drive mode or a reverse drive mode. An actuator can comprise an electric motor and can be configured to drive the switching mechanism. A coupling member can be configured to transmit a driving force from the actuator to the switching mechanism to actuate the switching mechanism. The coupling member can include a rod disposed on an axis of the electric motor, a first end of the rod being coupled to the switching mechanism and a second end of the rod being coupled to the electric motor so as to permit retracting movement and extending movement of the rod along the axis through the operation of the electric motor.

In accordance with another embodiment, a forward and reverse drive switching device for an outboard motor can comprise a switching mechanism configured to selectively set a propeller of the outboard motor to a forward drive mode or a reverse drive mode. An actuator can comprise an electric motor and can be configured to drive the switching mechanism. A coupling member can be configured to transmit a driving force from the actuator to the switching mechanism to actuate the switching mechanism. Additionally, the coupling member can include means for allowing the electric motor drive the switching mechanism and manual operation of the switching mechanism without disconnecting the electric motor.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

The embodiments of the forward and reverse drive switching device disclosed herein are described in the context of a marine propulsion system, and in some embodiments, an outboard motor of a boat because these embodiments have particular utility in this context. However, the embodiments and inventions herein can also be applied to other marine vessels, such as personal watercraft and small jet boats, as well as other land and marine vehicles. It is to be understood that the embodiments disclosed herein are exemplary but non-limiting embodiments, and thus, the inventions disclosed herein are not limited to the disclosed exemplary embodiments.

The forward and reverse drive switching device described below can provide a size reduction and thus enhanced mountability in the context of outboard motors. In some embodiments, the forward and reverse drive switching devices described below can be used in an outboard motor and can include a switching mechanism that is actuated so as to set a propeller to a forward drive mode or a reverse drive mode, an actuator having an electric motor and serving as a drive source for the switching mechanism, and a coupling member for transmitting a driving force from the actuator to the switching mechanism to actuate the switching mechanism.

The coupling member can include a rod disposed on an axis of the electric motor and an end coupled to the switching mechanism with the other end coupled to the electric motor to permit retracting and extending movements of the rod along the axis through the operation of the electric motor.

Figure 3:
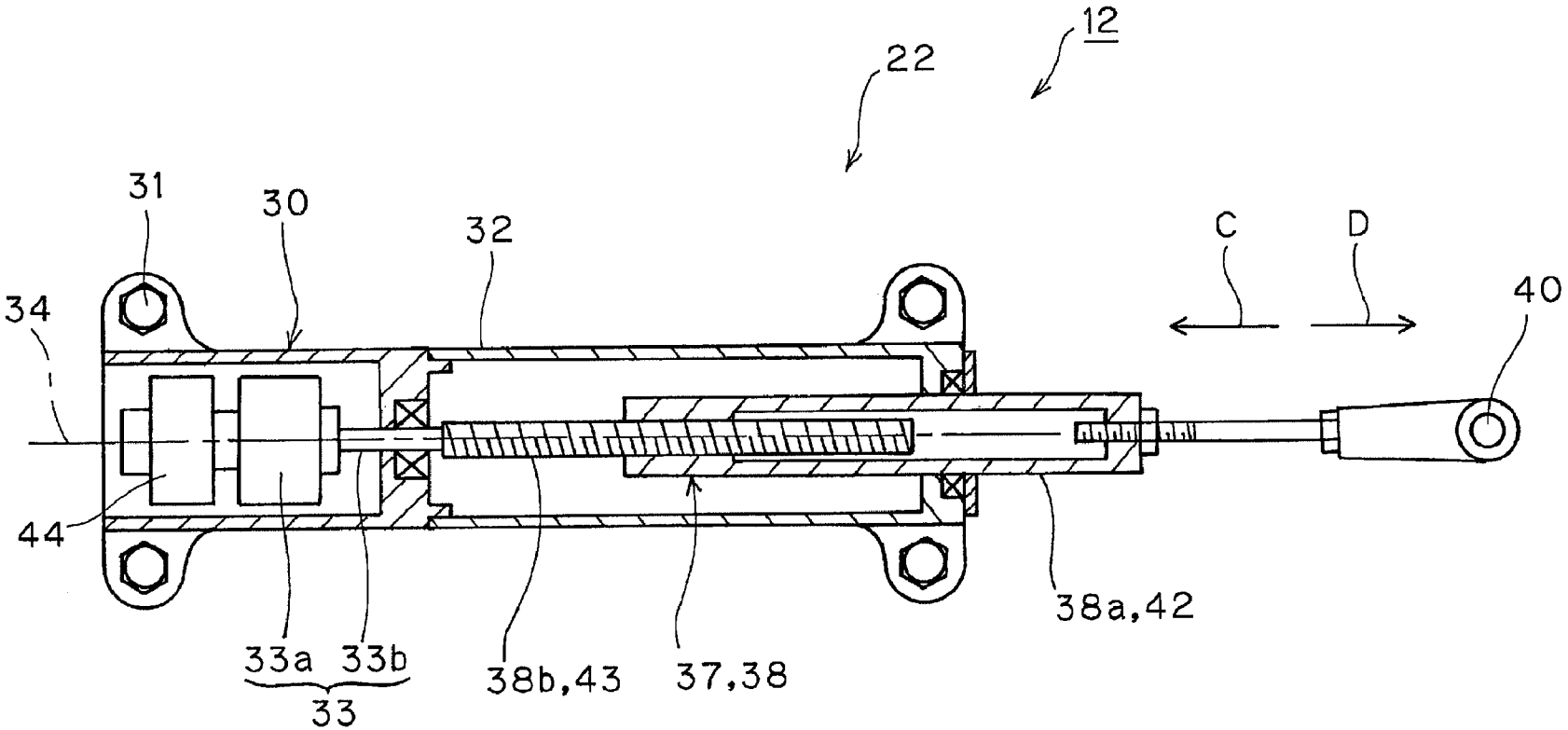
FIG. 3 is a sectional view of the actuator of FIG. 1.

With reference first to FIG. 3, the reference numeral 1 denotes a boat floating on water 2, and the arrow Fr indicates a forward direction in which the boat 1 is propelled. The boat 1 can have a hull 3 with an outboard motor 5 pivotally supported by the stern through a bracket 4. The boat 1 can be designed to be propelled forward or in reverse through the operation of the outboard motor 5.

The outboard motor 5 can include a casing 8, an internal combustion engine 9, a propeller 10, a power transmission device 11, a forward and reverse drive switching device 12, and a cowling 13. The casing 8 can be pivotally supported by the stern of the hull 3, can extend in a vertical direction, and can have a lower portion adapted to be submerged in the water 2.

The internal combustion engine 9 can be supported at the upper end of the casing 8. The propeller 10 can be supported at the lower end of the casing 8. The power transmission device 11 can be disposed in the casing 8 and can operatively couple the propeller 10 to the internal combustion engine 9.

The forward and reverse drive switching device 12 can be designed to set the propeller 10 to either a forward drive mode, a neutral mode or a reverse drive mode. The cowling 13 can selectively cover the internal combustion engine 9 and the forward and reverse drive switching device 12 entirely from above, and can be releasably secured to the casing 8.

The internal combustion engine 9 can have a crankcase 16 supported by the casing 8, and a crankshaft 18 with its axis 17 extending in the vertical direction and can be supported by the crankcase 16. An input shaft 19 of the power transmission device 11 can be operatively coupled to the crankshaft 18 on the axis 17.

The forward and reverse drive switching device 12 can have a switching mechanism 22 that can be actuated so as to engage with a part of the power transmission device 11 to set the propeller 10 to either the forward drive mode, the neutral mode or the reverse drive mode. However, other configurations can also be used.

The switching mechanism 22 can include a switching body 24, a shift shaft 26, a shift lever 27, and a positioning device 28. The switching body 24 can be disposed in the casing 8 and at the lower end thereof. Additionally, the switching body 24 can have forward and reverse drive gears and a dog clutch, and can be configured to engage directly with a part of the power transmission device 11.

The shift shaft 26 can be supported by the casing 8 for rotation about its vertical axis 25. Additionally, the shift shaft 26 can have a lower end connected to the switching body 24 and an upper end extending upwardly from the casing 8. The shift lever 27 can be formed so as to project from the upper end of the shift shaft 26. The positioning device 28 can be designed to elastically selectively hold (lock) the shift lever 27 in a certain pivotal position. However, other configurations can also be used.

When the shift lever 27 is in the pivotal position (shown by the solid line in FIG. 1) where the switching mechanism 22 is in the neutral mode, no power from the internal combustion engine 9 is transmitted to the propeller 10. If the shift lever 27 is permitted for forward pivotal movement A or reverse pivotal movement B from the position shown in the figure against an external force from the positioning device 28 so as to actuate the switching mechanism 22, the shift shaft 26, switching body 24, and power transmission device 11 can be operated in response to the shift lever 27, so that the power from the internal combustion engine 9 is transmitted through the power transmission device 11 to the propeller 10 for its forward or reverse rotation.

The forward and reverse drive switching device 12 can have an actuator 30 as a drive source for the switching mechanism 22. The actuator 30 can include a base 32 supported on the upper face of the casing 8 with fastening members 31, and an electric motor 33 supported by the base 32 and serving as a power source for the actuator 30. However, other configurations can also be used.

The base 32 can be a cylindrical case with an axis 34 extending substantially in a horizontal direction. The electric motor 33 can be a low-speed, high-torque type DC motor, and includes a housing 33*a* disposed on the axis 34 and supported by the base 32, and an output shaft 33*b* disposed in the housing 33*a* for outputting a driving force. However, other configurations can also be used. The power source for the electric motor 33 can be a battery rechargeable with electric power generated with the operation of the internal combustion engine 9.

The forward and reverse drive switching device 12 can have a coupling member 37 for operatively coupling the switching mechanism 22 to the electric motor 33 of the actuator 30. The coupling member 37 can include a rod 38, a rail 39, a slider 40, and a coupling link 41.

The rod 38 can be disposed on the axis 34 of the electric motor 33 and can be adapted for retracting C and extending movements D along the axis 34. In some embodiments, the longitudinal axis of the rod 38 can be disposed along or parallel to the axis 34 of the electric motor 33. An end 38*a* of the rod 38 can be coupled to the switching mechanism 22, and the other end 38*b* can be coupled to the output shaft 33*b* of the electric motor 33.

The rail 39 can be disposed forward in the direction of the extending movement D of the rod 38 and supported on the upper face of the casing 8, and extends in a direction parallel to the axis 34. The slider 40 rides on the rail 39 in a manner to slide in the longitudinal direction of the rail 39, and serves as a pivot support shaft that is coupled to the end 38*a* of the rod 38. The coupling link 41 operatively couples the shift lever 27 of the switching mechanism 22 and the slider 40. That is, the end 38*a* of the rod 38 can be coupled to the shift lever 27 of the switching mechanism 22 via the slider 40 and the coupling link 41.

The rod 38 can include a nut-like member 42 disposed on the axis 34 and forming the end 38*a* of the rod, as well as a bolt-like member 43 threadedly engaged with the nut-like member 42 via a plurality of balls (not shown) and forming the other end 38*b* of the rod. The rod 38 can be a so-called "ball screw" assembly. However, other configurations can also be used. The nut-like member 42 can have an adjustable length. In this case, the end 38*a* can be formed by the bolt-like member 43, and the other end 38*b* the nut-like member 42.

A position sensor 44 can be provided for detecting the position of the end 38*a* of the rod 38. The position sensor 44 can be disposed on the axis 34 and in a space defined by the base 32, and supported by the base 32.

A controller 45 can be provided for electronically controlling the electric motor 33 and the position sensor 44. The controller 45 can be configured to cause the position sensor 44 to detect the predetermined rotational speed of the electric motor 33, and based on the detection signal, detect the position of the other end 38*b* of the rod 38. When the end 38*a* has reached a predetermined position, the electric motor 33 stops.

At this time, the shift lever 27 operatively connected to the end 38*a* can be brought to a predetermined position for the forward pivotal movement A, neutral, or the reverse pivotal movement B. In this case, the shift lever 27 is held in the predetermined position by the positioning device 28.

The forward and reverse drive switching device 12 can include an operation member 46 to permit the forward and reverse pivotal movements A, B of the shift lever 27 of the switching mechanism 22 through manual operation. The operation member 46 can extend in the longitudinal direction of the hull 3, and has an end 46*a* coupled to the end 38*a* of the rod 38 through the slider 40 and the other end 46*b* for inputting an external operation force. The operation member 46 can be passed through the front portion of the cowling 13, at its longitudinal halfway part. The other end 46*b* of the operation member 46 can be located outside the cowling 13 and projects toward the hull 3.

The cowling 13 can have a guide member 47 attached to the front portion thereof. The guide member 47 can have the halfway part of the operation member 46 passed therethrough and can serve to guide the operation member 46 in a manner to move only in the longitudinal direction thereof.

When an operator in the hull 3 inputs an operation force to the other end 46*b* of the operation member 46, the operation force can be input in the longitudinal direction of the rod 38 to the end 38*a* of the rod 38.

When the electric motor 33 is not in operation, the output shaft 33*b* of the electric motor 33 can be rotatable relative to the housing 33*a*. In addition, since the rod 38 includes a ball screw assembly, relative rotation between the end 38*a* and the other end 38*b* about the axis 34 and relative axial movement between the end 38*a* and the other end 38*b* are made smoothly regardless of either the end 38*a* or the other end 38*b* serving as the input side. Thus, as described above, when an operation force is input to the other end 46*b* of the operation member 46 to permit pulling movement E or pushing movement F of the operation member 46, the operation force can be input to the end 38*a* of the rod 38, so that the end 38*a* and the other end 38*b* of the rod 38 are made to rotate smoothly relative to each other about the axis 34, permitting smooth retracting movement C or extending movement D of the rod 38.

Figure 1:
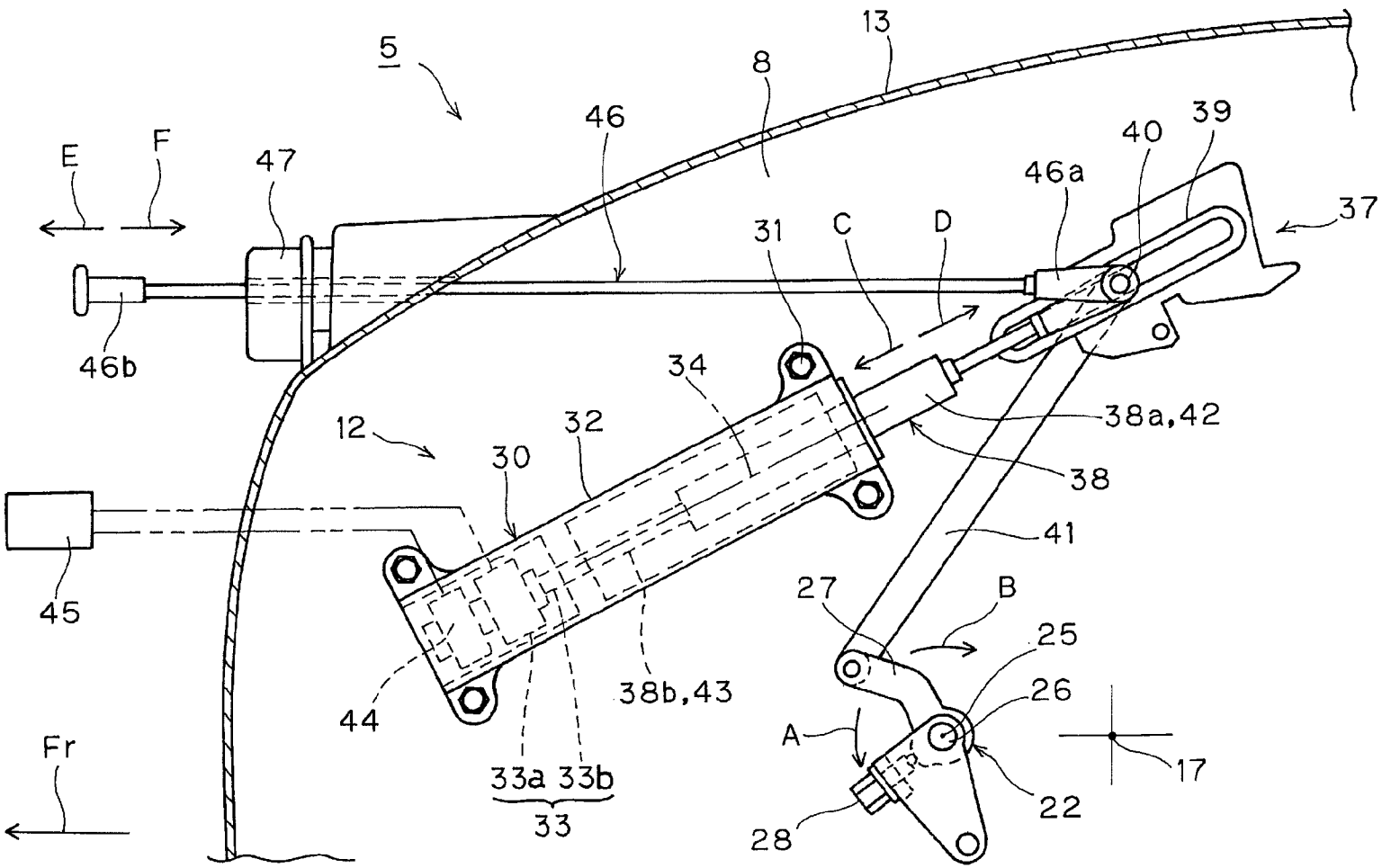
FIG. 1 is a schematic plan view of a forward and reverse drive switching device having an actuator in accordance with an embodiment, with some internal components of the switching mechanism shown in phantom line.
Figure 2:
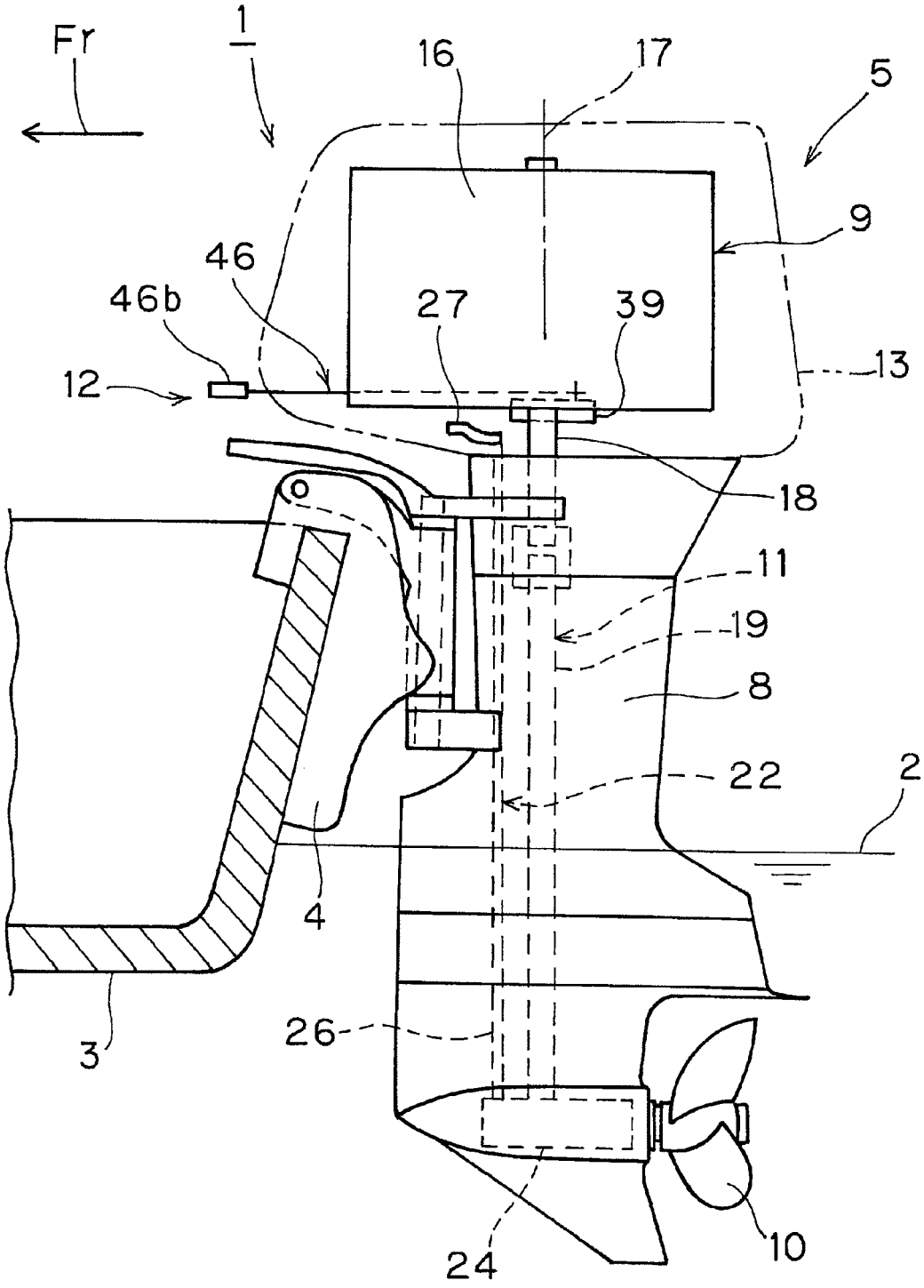
FIG. 2 is a schematic side view of an outboard motor that can include the switching device illustrated in FIG. 1.

When the boat 1 is operated, the operator in the hull 3 can first perform operation to the controller 45 so as to change the switching mechanism 22 of the forward and reverse drive switching device 12 into the neutral mode (shown in FIGS. 1 through 3). With the switching mechanism 22 in the neutral mode, the operation of the internal combustion engine 9 can be started.

To achieve forward running of the boat 1, the operator can perform an operation on the controller 45 so as to drive the electric motor 33 of the actuator 30 to cause the retracting movement C of the rod 38. This causes the slider 40 coupled to the end 38*a* of the rod 38 to slide along the rail 39, which in turn, causes the shift lever 27 of the switching mechanism 22, coupled to the slider through the coupling link 41, to make the forward pivotal movement A. As a result, the switching body 24 of the switching mechanism 22 sets the propeller 10 to the forward drive mode, so that the boat 1 can be propelled forwardly.

On the other hand, for the reverse running of the boat 1, the operator can perform an operation on the controller 45, with the switching mechanism 22 in the neutral mode, so as to drive the electric motor 33 of the actuator 30 to permit the extending movement D of the rod 38. This causes the slider 40 coupled to the end 38*a* of the rod 38 to slide along the rail 39, which in turn, causes the shift lever 27 of the switching mechanism 22, coupled to the slider 40 through the coupling link 41, to make the reverse pivotal movement B. As a result, the switching body 24 of the switching mechanism 22 sets the propeller 10 to the reverse drive mode, so that the boat 1 can be propelled in reverse.

In the above case, the electric motor 33 and the rod 38 can be located on the same axis 34, and the rail 39 can extend in the direction parallel to the axis 34. This can allow power transmission between the rod 38 and the slider 40, which moves along the rail 39, with less mechanical loss and increased efficiency.

In the above structure, the coupling member 37 can include the rod 38. The rod 38 can be disposed on the axis 34 of the electric motor 33 and can have the end 38*a* coupled to the switching mechanism 22 and the other end 38*b* coupled to the electric motor 33 to permit the retracting movement C and the extending movement D of the rod along the axis 34 through the operation of the electric motor 33.

Since the coupling member 37 can be constructed by using the rod 38, or simple linear member, and the rod 38 can be disposed on the same axis 34 as the electric motor 33, the coupling structure between the rod 38 and the electric motor 33 can be reduced in size, and ultimately, the forward and reverse drive switching device 12 can be reduced in size compared to the conventional art using a gear set. This provides enhanced mountability of the forward and reverse drive switching device 12 to the outboard motor 5.

In addition, as described above, the rod 38 of the coupling member 37 can be disposed on the axis 34 of the electric motor 33, so that the power of the electric motor 33 can be transmitted more directly to the switching mechanism 22. It is thus possible to minimize mechanical loss compared to the conventional art using a gear set, effecting a size reduction of the electric motor 33. This provides further enhanced mountability of the forward and reverse drive switching device 12 to the outboard motor 5.

Further, as described above, the rod 38 can include the nut-like member 42 disposed on the axis 34 and the bolt-like member 43 threadedly engaged with the nut-like member 42 via the balls, and one of the members 42, 43 can be coupled to the switching mechanism 22 and the other can be coupled to the electric motor 33.

The rod 38 can also include a so-called ball screw assembly, so that mechanical loss can be further minimized. It is thus possible to minimize the capacity of the electric motor 33 further, effecting a further size reduction of the forward and reverse drive switching device 12. This provides further enhanced mountability of the forward and reverse drive switching device 12 to the outboard motor 5, correspondingly.

Meanwhile, in the event of a failure of the actuator 30 for example, the operator can perform an operation to the shift lever 27 of the switching mechanism 22 not through the operation of the actuator 30, but manually so as to actuate the switching mechanism 22. In this case, the operation force can be applied to the shift lever 27 of the switching mechanism 22, while being applied to one of the nut-like member 42 and the bolt-like member 43 of the rod 38.

As described above, since the rod 38 can include a ball screw assembly, the other member and the electric motor 33 coupled thereto are rotated smoothly relative to the one member about the axis 34, which permits smooth retracting movement C or extending movement D of the rod 38. Thus, while the rod 38 is made to move due to the operation force, it can be possible to operate the shift lever 27 of the switching mechanism 22 easily. In other words, the switching mechanism 22 can be manually actuated smoothly, while the coupling of the switching mechanism 22 to the actuator 30 through the coupling member 37 can be maintained.

Therefore, in the event of a failure of the actuator 30 for example, when the operator performs switching operation to the forward and reverse drive switching device 12 by actuating the switching mechanism 22 manually, the manual switching operation can be performed easily since the coupling of the switching mechanism 22 to the actuator 30 through the coupling member 37 need not be released.

Further, as described above, the position sensor 44 can be provided for detecting the position of the end 38*a* of the rod 38 and the position sensor 44 can be disposed on the axis 34.

Thus, the electric motor 33, the rod 38, and the position sensor 44 that construct the forward and reverse drive switching device 12 can all disposed on the axis 34, thereby providing a simplified structure of the forward and reverse drive switching device 12 with accuracy, and more compact arrangement of these elements 33, 38, 44. Therefore, a further size reduction of the forward and reverse drive switching device 12 can be effected, and further enhanced mountability of the forward and reverse drive switching device 12 to the outboard motor 5 can be provided.

Further, as described above, the operation member 46 can be provided having the end 46*a* coupled to the end 38*a* of the rod 38 and the other end 46*b* for inputting an external manual operation force.

Thus, locating the other end 46*b* of the operation member 46 in a desired place and inputting an operation force to the other end 46*b* results in easy manual operation of the switching mechanism 22 from the position remote from the rod 38 of the coupling member 37. That is, manual switching operation to the forward and reverse drive switching device 12 can be performed easily.

In some embodiments, the other end 46*b* of the operation member 46 can be disposed forward of and outside the cowling 13 to project toward the hull 3.

This makes it possible for the operator on the hull 3 to give an input of an operation force to the other end 46*b* of the operation member 46 without removing the cowling 13 from the casing 8. As such, manual operation of the switching mechanism 22 can be performed more easily.

Figure 4:
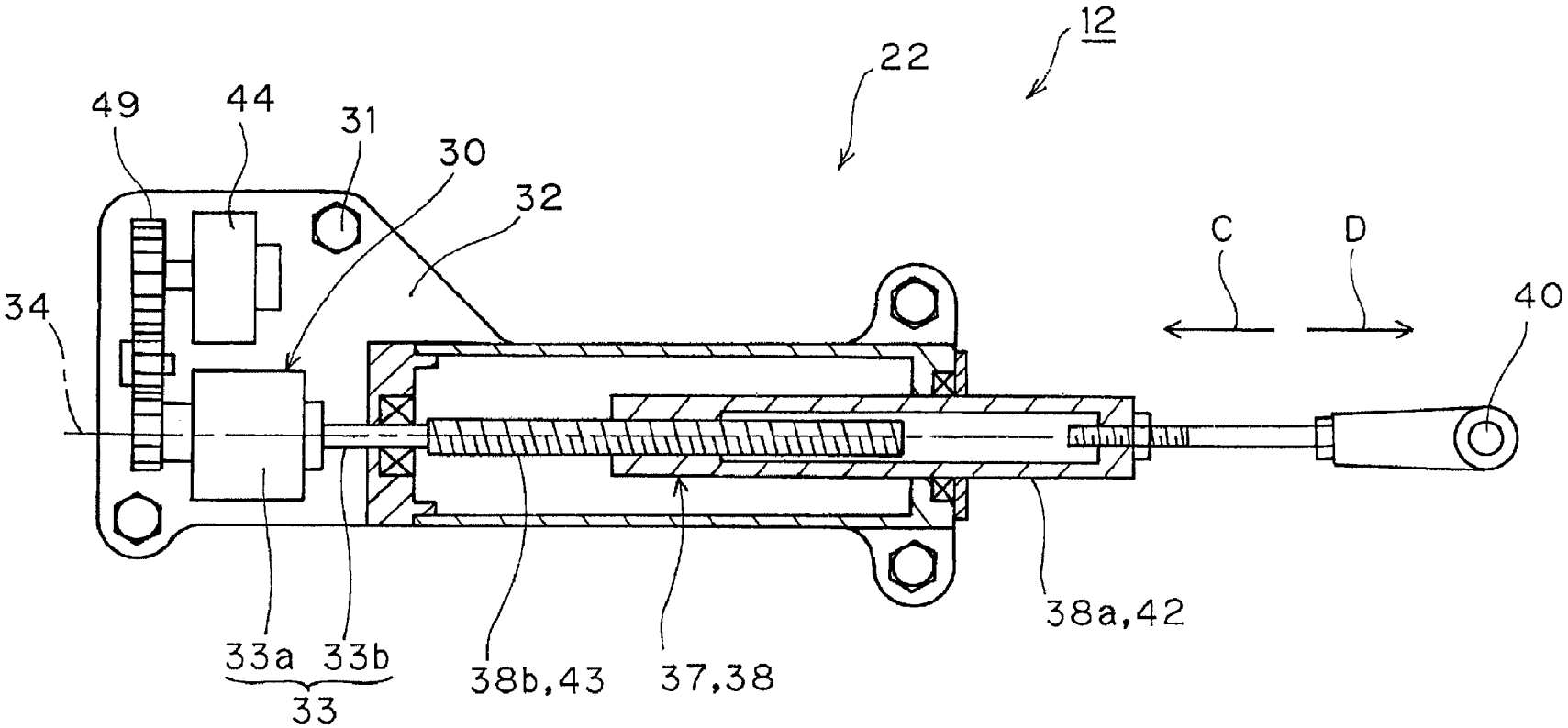
FIG. 4 is a sectional view of a modification of the actuator of FIG. 1.
Figure 5:
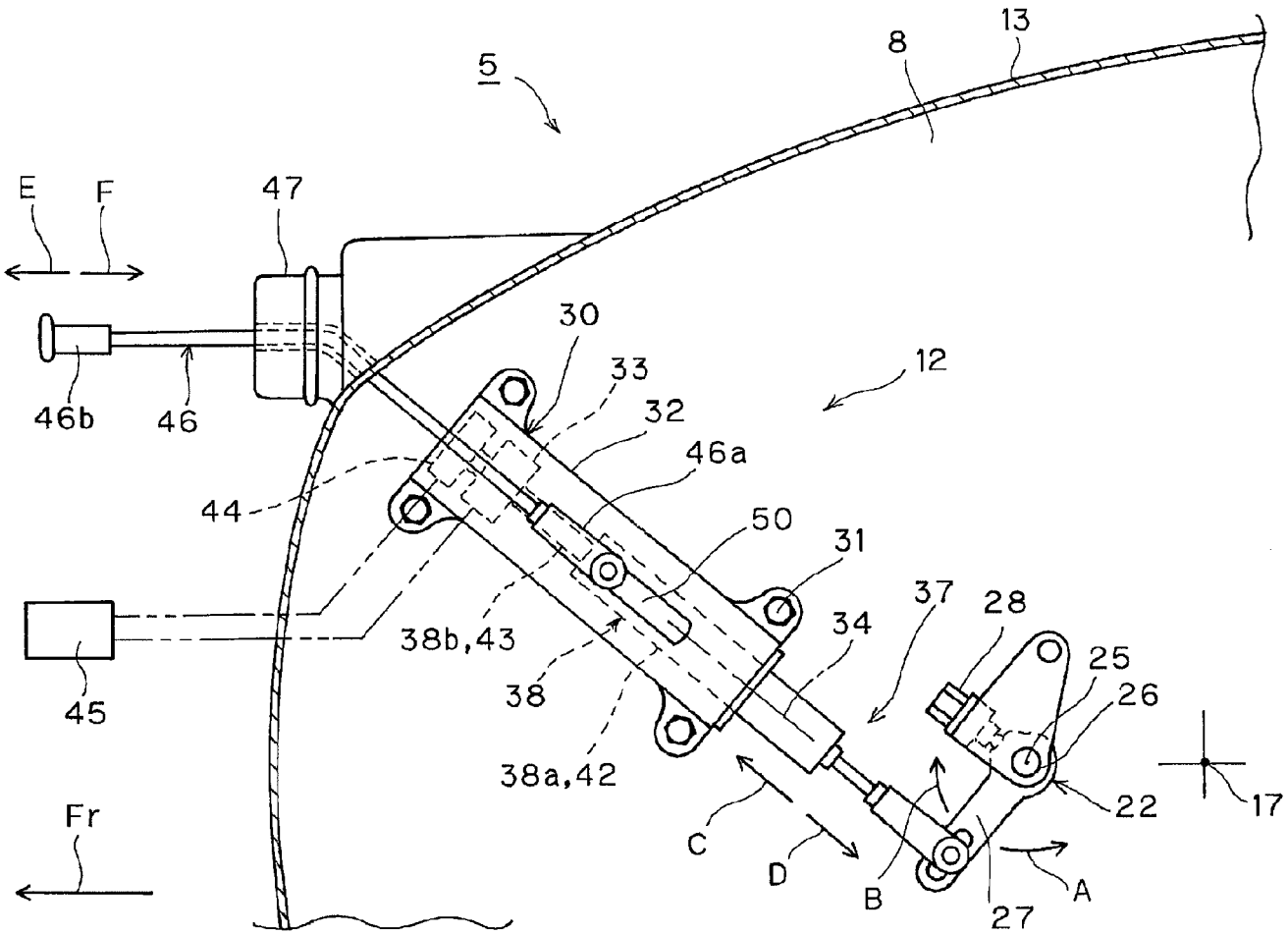
FIG. 5 is a sectional view of another modification of the actuator of FIG. 1.

FIGS. 4 and 5 show modifications of the switching mechanism 22. The components, functions and effects of these modifications are similar in many respects to those of the first embodiment above. Therefore, those parts corresponding to the components in the switching mechanism 22 are identified with the same reference numerals in the drawings and their description can be omitted, and their differences are mainly described below. The configurations of the parts of the various modifications of the switching mechanism 22 can be combined in various ways in the light of the disclosure set forth herein as appreciated by one of ordinary skill in the art.

With reference to FIG. 4, the position sensor 44 can be disposed in a side-by-side relationship with the electric motor 33. Additionally, the electric motor 33 and the position sensor 44 can be operatively coupled to each other via a reduction gear set 49.

In the above structure, with the limited detection angle range of the position sensor 44, the rotational angle of the electric motor 33 (the rotational angle of the end 38*a* of the rod 38) adapted for making a large number of turns can be detected due to the speed reduction operation of the gear set 49. It is thus possible to effect simplified control of the position sensor 44 and minimize the price.

Referring to FIG. 5, the end 38*a* of the rod 38 can be directly coupled to the shift lever 27 of the switching mechanism 22. The end 46*a* of the operation member 46 can be coupled to the end 38*a* of the rod 38 through a slot 50 formed in the base 32. The operation member 46 can be constructed of a flexible wire.

In the above structure, an input of an operation force to the other end 46*b* of the operation member 46 moves the end 38*a* of the rod 38 more directly. This can eliminate the need for an input of a large operation force to the other end 46*b* of the operation member 46. In addition, it is possible to mount the actuator 30 and the operation member 46 to the casing 8 as an assembly, providing enhanced assembling characteristics of the outboard motor 5.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A forward and reverse drive switching device for an outboard motor, comprising a switching mechanism configured to selectively set a propeller of the outboard motor to a forward drive mode or a reverse drive mode, an actuator comprising an electric motor and being configured to drive the switching mechanism, and a coupling member configured to transmit a driving force from the actuator to the switching mechanism to actuate the switching mechanism, wherein the coupling member includes a rod disposed on a rotational axis of the electric motor, a first end of the rod being coupled to the switching mechanism and a second end of the rod being coupled to the electric motor so as to permit retracting movement and extending movement of the rod along the axis through the operation of the electric motor.

2. The forward and reverse drive switching device for an outboard motor according to claim 1, additionally comprising a position sensor configured to detect a position of an end of the rod, the position sensor being disposed on the axis.

3. The forward and reverse drive switching device for an outboard motor according to claim 1, wherein a longitudinal axis of the rod is disposed along or parallel to the axis of the electric motor.

4. A forward and reverse drive switching device for an outboard motor, comprising a switching mechanism configured to selectively set a propeller of the outboard motor to a forward drive mode or a reverse drive mode, an actuator comprising an electric motor and being configured to drive the switching mechanism, and a coupling member configured to transmit a driving force from the actuator to the switching mechanism to actuate the switching mechanism, wherein the coupling member includes a rod disposed on an axis of the electric motor, a first end of the rod being coupled to the switching mechanism and a second end of the rod being coupled to the electric motor so as to permit retracting movement and extending movement of the rod along the axis through the operation of the electric motor wherein the rod comprises a nut-like member disposed on the axis and a bolt-like member threadedly engaged with the nut-like member via balls, one of the nut-like member and bolt-like member being coupled to the switching mechanism and the other of the nut-like member and bolt-like member being coupled to the electric motor.

5. The forward and reverse drive switching device for an outboard motor according to claim 4, additionally comprising an operation member having an end coupled to an end of the rod and the other end for inputting an external manual operation force.

6. A forward and reverse drive switching device for an outboard motor, comprising a switching mechanism configured to selectively set a propeller of the outboard motor to a forward drive mode or a reverse drive mode, an actuator comprising an electric motor and being configured to drive the switching mechanism, and a coupling member configured to transmit a driving force from the actuator to the switching mechanism to actuate the switching mechanism, wherein the coupling member includes a rod disposed on an axis of the electric motor, a first end of the rod being coupled to the switching mechanism and a second end of the rod being coupled to the electric motor so as to permit retracting movement and extending movement of the rod along the axis through the operation of the electric motor, wherein a longitudinal axis of the rod is disposed along or parallel to the axis of the electric motor wherein the axis of the electric motor is a rotational axis of an output shaft of the electric motor.

7. A forward and reverse drive switching device for an outboard motor, comprising a switching mechanism configured to selectively set a propeller of the outboard motor to a forward drive mode or a reverse drive mode, an actuator comprising an electric motor and being configured to drive the switching mechanism, and a coupling member configured to move along or parallel to a rotational axis of electric motor so as to transmit a driving force from the actuator to the switching mechanism to actuate the switching mechanism, the coupling member including means for allowing the electric motor drive the switching mechanism and manual operation of the switching mechanism without disconnecting the electric motor.

* * * * *